US005510882A

United States Patent [19]

Kikuta et al.

[11] Patent Number: 5,510,882

[45] Date of Patent: Apr. 23, 1996

[54] DEVELOPING DEVICE HAVING AN IMPROVED AGITATION AND CONVEYANCE DEVICE

[75] Inventors: Shinji Kikuta; Motoyuki Fukuda; Tsutomu Nagata; Toshio Nishino; Akihiko Ichiba, all of Osaka, Japan

[73] Assignee: Mita Industrial Co., Ltd., Osaka, Japan

[21] Appl. No.: 352,620

[22] Filed: Dec. 9, 1994

[30] Foreign Application Priority Data

Dec. 17, 1993 [JP] Japan ..... 5-317671

[51] Int. Cl.[6] ..... G03G 15/06

[52] U.S. Cl. ..... 355/245; 118/653; 118/657; 355/246; 355/251

[58] Field of Search ..... 355/245, 246, 355/251, 253, 260; 118/653, 656–658; 222/DIG. 1

[56] References Cited

U.S. PATENT DOCUMENTS 4,724,457 2/1988 Abreu et al. ..... 118/657 X
4,864,349 9/1989 Ito ..... 355/253
5,122,834 6/1992 Okamoto et al. ..... 355/246 X
5,204,721 4/1993 Sharpe ..... 355/260

*Primary Examiner*—William J. Royer
*Attorney, Agent, or Firm*—Antonelli, Terry, Stout & Kraus

[57] ABSTRACT

A latent electrostatic image developing device using a developer including a toner and carrier particles has a development housing, in which an upstream agitating/conveying device, a midstream agitating/conveying device, and a downstream agitating/conveying device are disposed. The upstream agitating/conveying device conveys the developer from the central portion in the widthwise direction toward the opposite end portions in the widthwise direction while agitating it, the midstream agitating/conveying device conveys the developer from the opposite end portions in the widthwise direction toward the central portion in the widthwise direction while agitating it, and the downstream agitating/conveying device conveys the developer from the central portion in the widthwise direction toward the opposite end portions in the widthwise direction while agitating it.

21 Claims, 3 Drawing Sheets

DEVELOPING DEVICE HAVING AN IMPROVED AGITATION AND CONVEYANCE DEVICE

FIELD OF THE INVENTION

This invention relates to a latent electrostatic image developing device for use in developing a latent electrostatic image to a toner image in image forming apparatuses such as electrostatic copying machines and electrostatic printing machines. More specifically, it relates to a latent electrostatic image developing device of the type using a developer comprising a toner and carrier particles.

DESCRIPTION OF THE PRIOR ART

As is well known, a latent electrostatic image developing device of the type using a developer comprising a toner and carrier particles is widely used to develop a latent electrostatic image in image forming apparatuses. This latent electrostatic image developing device has a development housing for accommodating a developer, a developer applicator means for applying the developer in the development housing to a latent electrostatic image, a developer agitating/conveying means for agitating the developer in the development housing and conveying it in a desired direction, and a toner feed means for supplying a toner into the development housing. The developer applicator means usually includes a rotating sleeve member, on whose peripheral surface the developer is held to be conveyed to a developing zone. In the developing zone, a toner in the developer is selectively adhered to a latent electrostatic image, whereby the latent image is developed to a toner image. When the toner in the developer has been consumed with the development of the latent electrostatic image, a toner is supplied by the toner feed means into the development housing. The developer agitating/conveying means agitates the developer within the development housing to mix and frictionally charge the toner and the carrier particles, while conveying the developer in a predetermined direction.

In the above-mentioned type of latent electrostatic image developing device, it is important that the developer be agitated sufficiently satisfactorily before being held on the developer applicator means and conveyed to the developing zone, and that the developer having the toner and the carrier particles mixed sufficiently uniformly in a proportion within a predetermined range be applied to the latent electrostatic image. It is also important that in the downstream side of the developing zone, the developer having the toner of the reduced proportion as a result of the adhesion of the toner to the latent electrostatic image be effectively released from the developer applicator means so as to be agitated and conveyed again within the development housing. To fulfill such requirements for agitating and conveying the developer, Japanese Utility Model Publication No. 27333/1975 and Japanese Laid-Open Patent Publication No. 260678/1991 disclose the construction of a development agitating/conveying means from a downstream agitating/conveying means extending adjacent to a developer applicator means and an upstream agitating/conveying means disposed upstream of the downstream agitating/conveying means. The upstream agitating/conveying means comprises a rotating shaft extending in a widthwise direction (i.e. the axial direction of the rotating sleeve member in the developer applicator means), and a pair of helical blades which are formed at a distance in the widthwise direction on the rotating shaft and helically wound about the rotating shaft in opposite directions to each other. The downstream agitating/conveying means also comprises a rotating shaft extending in the widthwise direction, and a pair of helical blades formed at a distance in the widthwise direction on the rotating shaft and helically wound about the rotating shaft in opposite directions to each other. The upstream agitating/conveying means is rotated in a predetermined direction, and conveys the developer from the opposite end portions in the widthwise direction toward the central portion in the widthwise direction while agitating it, and transfers the developer to the central portion in the widthwise direction of the downstream agitating/conveying means. The downstream agitating/conveying means rotated similarly in a predetermined direction conveys the developer from the central portion in the widthwise direction toward the opposite end portions in the widthwise direction while agitating it, and transfers the developer at the opposite end portions in the widthwise direction to the upstream agitating/conveying means. The developer conveyed by the downstream agitating/conveying means from the central portion in the widthwise direction toward the opposite end portions in the widthwise direction is held by the developer applicator means for conveyance to the developing zone. Japanese Laid-Open Patent Publication No. 260678/1991 further discloses that an inclined elliptic plate is disposed between the pair of helical blades on the rotating shaft of the downstream agitating/conveying means to distribute the developer conveyed from one of the end portions to the central portion of the upstream agitating/conveying means, to both sides of the downstream agitating/conveying means, as well as to distribute the developer conveyed from the other end portion to the central portion of the upstream agitating/conveying means, to both sides of the downstream agitating/conveying means, thereby ensuring the flow of the developer between one of the sides in the widthwise direction and the other side in the widthwise direction, and making the developer uniform throughout the widthwise direction.

However, the latent electrostatic image developing devices disclosed in Japanese Utility Model Publication No. 27333/1975 and Japanese Laid-Open Patent Publication No. 260678/1991 are not entirely satisfactory, and pose the following problems to be solved: First, the toner and the carrier particles are not thoroughly mixed. When a latent electrostatic image having a toner adhesion region (image region) biased to one of the sides in the widthwise direction is developed, for instance, the proportions of the toner and the carrier particles mixed in the developer become nonuniform in the widthwise direction, and such nonuniformity remains for a relatively long period of time. Second, when the concentration of the toner in the developer (the proportion of the toner in the developer) decreases to a level below a predetermined value, this decrease is detected, so that the toner is fed into the development housing. In this case, part of the toner fed may be directly conveyed to the developer applicator means without being thoroughly agitated. Thus, a site where an insufficiently agitated toner exists may be locally formed in the developer held on the developer applicator means. Third, there is a tendency for the local lack of the developer at the central portion in the widthwise direction of the developer applicator means owing to the inclined elliptic plate formed at the central portion in the widthwise direction of the rotating shaft in the downstream agitating/conveying means.

SUMMARY OF THE INVENTION

An object of the present invention is to provide a novel, excellent latent electrostatic image developing device improved in the agitation and conveyance of the developer, in which the toner and the carrier particles are thoroughly mixed; even when a latent electrostatic image having a toner adhesion region biased to one of the sides in the widthwise direction is developed, the mixing ratio of the toner and the carrier particles in the developer is fully prevented from becoming nonuniform in the widthwise direction; and such nonuniformity, if any, can be eliminated sufficiently rapidly.

Another object of the present invention is to provide a novel, excellent latent electrostatic image developing device improved in the agitation and conveyance of the developer, in which even immediately after the toner is fed into the development housing, the incorporation of an insufficiently agitated toner in the developer held on the developer applicator means for conveyance to the developing zone is reliably prevented.

Still another object of the present invention is to provide a novel, excellent latent electrostatic image developing device improved in the agitation and conveyance of the developer, in which a desired amount of the developer is held on the developer applicator means stably and sufficiently uniformly in the widthwise direction.

To attain the above objects, in the latent electrostatic image developing device of the present invention, the developer agitating/conveying means for agitating and conveying the developer within the development housing includes an upstream agitating/conveying means, a midstream agitating/conveying means, and a downstream agitating/conveying means. An upstream partitioning means and a downstream partitioning means, each extending in the widthwise direction, are disposed in the development housing, and developer transfer openings are disposed at opposite end portions in the widthwise direction and a central portion in the widthwise direction of each of the upstream and downstream partitioning means. The upstream agitating/conveying means is disposed on the upstream side of the upstream partitioning means, the midstream agitating/conveying means is disposed between the upstream partitioning means and the downstream partitioning means, the downstream agitating/conveying means is disposed on the downstream side of the downstream partitioning means, and the developer applicator means is disposed on the downstream side of the downstream agitating/conveying means. The upstream agitating/conveying means is so constructed as to convey the developer from the central portion in the widthwise direction toward the opposite end portions in the widthwise direction while agitating it, the midstream agitating/conveying means is so constructed as to convey the developer from the opposite end portions in the widthwise direction toward the central portion in the widthwise direction while agitating it, and the downstream agitating/conveying means is so constructed as to convey the developer from the central portion in the widthwise direction toward the opposite end portions in the widthwise direction while agitating it. The toner feed means advantageously let fall the toner onto the central portion in the widthwise direction of the upstream agitating/conveying means.

According to an aspect of the present invention, the conveying capacity of the midstream agitating/conveying means is made greater than the conveying capacity of the upstream agitating/conveying means and the conveying capacity of the downstream agitating/conveying means. Preferably, the conveying capacity of the midstream agitating/conveying means is nearly equal to the sum of the conveying capacity of the upstream agitating/conveying means and the conveying capacity of the downstream agitating/conveying means, and the conveying capacity of the downstream agitating/conveying means is greater than the conveying capacity of the upstream agitating/conveying means. Advantageously, the conveying capacity of the downstream agitating/conveying means is 1.2 to 2.5 times as large as the conveying capacity of the upstream agitating/conveying means.

According to another aspect of the present invention, the size in the widthwise direction of the developer transfer opening disposed at the central portion in the widthwise direction of the downstream partitioning means is made greater than the size in the widthwise direction of the developer transfer opening disposed at the central portion in the widthwise direction of the upstream partitioning means. Preferably, the size in the widthwise direction of the developer transfer opening disposed at the central portion in the widthwise direction of the downstream partitioning means is 1.3 to 4.0 times as large as the size in the widthwise direction of the developer transfer opening disposed at the central portion in the widthwise direction of the upstream partitioning means.

According to still another aspect of the present invention, the upstream agitating/conveying means, the midstream agitating/conveying means, and the downstream agitating/conveying means are each comprised of a rotating shaft extending in the widthwise direction, and a pair of helical blades formed at a distance in the widthwise direction on the rotating shaft and helically wound about the rotating shaft in opposite directions to each other. In each of the upstream and midstream agitating/conveying means, an inclined elliptic plate is formed on the rotating shaft between the pair of helical blades. In the downstream agitating/conveying means, on the other hand, an inclined elliptic plate is not formed on the rotating shaft between the pair of helical blades. Preferably, the size in the widthwise direction of the inclined elliptic plate of the upstream agitating/conveying means is nearly equal to the size in the widthwise direction of the developer transfer opening disposed at the central portion in the widthwise direction of the upstream partitioning means, and the size in the widthwise direction of the inclined elliptic plate of the midstream agitating/conveying means is nearly equal to the size in the widthwise direction of the developer transfer opening disposed at the central portion in the widthwise direction of the downstream partitioning means. In each of the upstream and downstream agitating/conveying means, it is advantageous that auxiliary helical blades urging the developer inwards in the widthwise direction be formed at opposite end portions of the rotating shaft.

In the latent electrostatic image developing device of the present invention, the developer is conveyed by the upstream agitating/conveying means from the central portion in the widthwise direction to the opposite end portions in the widthwise direction while being agitated, transferred at the opposite end portions in the widthwise direction to the midstream agitating/conveying means, and then conveyed by the midstream agitating/conveying means to the central portion in the widthwise direction while being agitated. At the central portion in the widthwise direction, the developer is partly transferred to the downstream agitating/conveying means, and partly returned to the upstream agitating/conveying means. The developer transferred to the downstream agitating/conveying means is conveyed by the downstream agitating/conveying means from the central portion in the widthwise direction to the opposite end portions in the widthwise direction while being agitated. The developer conveyed to the opposite end portions in the widthwise direction by the downstream agitating/conveying means is returned at the opposite end portions in the widthwise direction to the midstream agitating/conveying means, and conveyed by the midstream agitating/conveying means from the opposite end portions in the widthwise direction to the central portion in the widthwise direction while being agitated. During conveyance by the upstream agitating/conveying means from the central portion in the widthwise direction to the opposite end portions in the widthwise direction, and subsequent conveyance by the midstream agitating/conveying means from the opposite end portions in the widthwise direction to the central portion in the widthwise direction, the developer is fully agitated, with the result that the toner and the carrier particles are mixed sufficiently uniformly. The developer conveyed by the downstream agitating/conveying means from the central portion in the widthwise direction to the opposite end portions in the widthwise direction is partly conveyed to the developing zone while being held on the developer applicator means, and is applied to a latent electrostatic image there. The developer having the toner concentration reduced as a result of the adhesion of the toner to the latent electrostatic image is released from the developer applicator means on the downstream side of the developing zone. Then, the developer is conveyed, while being agitated, by the downstream agitating/conveying means to the opposite end portions in the widthwise direction, transferred from there to the midstream agitating/conveying means, and conveyed by this means from the opposite end portions in the widthwise direction to the central portion in the widthwise direction. On this occasion, the developer is mixed with the developer transferred from the upstream agitating/conveying means to the midstream agitating/conveying means.

If the directions of the widthwise conveyance of the developer in the upstream, midstream and downstream agitating/conveying means are rendered reverse to the above-mentioned directions, the developer in the downstream agitating/conveying means is conveyed from the opposite end portions in the widthwise direction to the central portion in the widthwise direction. In this case, our experience has shown that the developer held on the developer applicator means may fail to be sufficiently uniform in the entire widthwise direction.

The conveyance of the developer from the opposite end portions in the widthwise direction to the central portion in the widthwise direction is performed by the midstream agitating/conveying means, while the conveyance of the developer from the central portion in the widthwise direction to the opposite end portions in the widthwise direction is carried out by each of the upstream and downstream agitating/conveying means. The conveying capacity of the midstream agitating/conveying means is relatively large, whereas those of the upstream and downstream agitating/conveying means are relatively small. Hence, the developer is not biased to the opposite end portions in the widthwise direction or to the central portion in the widthwise direction, so that the developer is distributed sufficiently uniformly in the entire widthwise direction. Since the conveying capacity of the upstream agitating/conveying means is relatively small, the developer is thoroughly agitated during its relatively low speed conveyance by the upstream agitating/conveying means from the central portion in the widthwise direction to the opposite end portions in the widthwise direction. Since the conveying capacity of the midstream agitating/conveying means is relatively large, a relatively large amount of the developer is transferred at the central portion in the widthwise direction from the midstream agitating/conveying means to the downstream agitating/conveying means, thus resulting in no lack of the developer held on the developer applicator means. If the conveying capacity of the downstream agitating/conveying means is smaller than the conveying capacity of the midstream agitating/conveying means, but greater than the conveying capacity of the upstream agitating/conveying means, the developer having the toner concentration reduced as a result of the toner adhesion to the latent electrostatic image is released sufficiently satisfactorily from the developer applicator means on the downstream side of the developing zone, and returned to the midstream agitating/conveying means relatively rapidly.

Since the size in the widthwise direction of the developer transfer opening disposed at the central portion in the widthwise direction of the downstream partitioning means is relatively large, a sufficient amount of the developer can be transferred at the central portion in the widthwise direction from the midstream agitating/conveying means to the downstream agitating/conveying means. Since the size in the widthwise direction of the developer transfer opening disposed at the central portion in the widthwise direction of the upstream partitioning means is relatively small, on the other hand, it is permissible for the developer to be partly returned at the central portion in the widthwise direction from the midstream agitating/conveying means to the upstream agitating/conveying means, but it can be prevented reliably that the toner fed at the central portion in the widthwise direction to the upstream agitating/conveying means is transferred directly to the midstream agitating/conveying means without being agitated.

In each of the upstream and midstream agitating/conveying means, the inclined elliptic plate is formed at the central portion in the widthwise direction of the rotating shaft. Therefore, the developer on one of the sides and the developer on the other side are appropriately mixed at the central portion in the widthwise direction of each of the upstream and midstream agitating/conveying means, with the result that the developer is distributed sufficiently uniformly in the entire widthwise direction, and also the proportions of the toner and the carrier particles are sufficiently uniform in the entire widthwise direction. Moreover, the downstream agitating/conveying means has no inclined elliptic plate formed at the central portion in the widthwise direction. Thus, the tendency that the developer held on the developer applicator means is deficient at the central portion in the widthwise direction can be prevented reliably.

DETAILED DESCRIPTION OF THE PREFERRED EMBODIMENTS

The present invention will be described in more detail below with reference to the accompanying drawings illustrating preferred embodiments of the latent electrostatic image developing device constructed in accordance with the invention.

Figure 1:
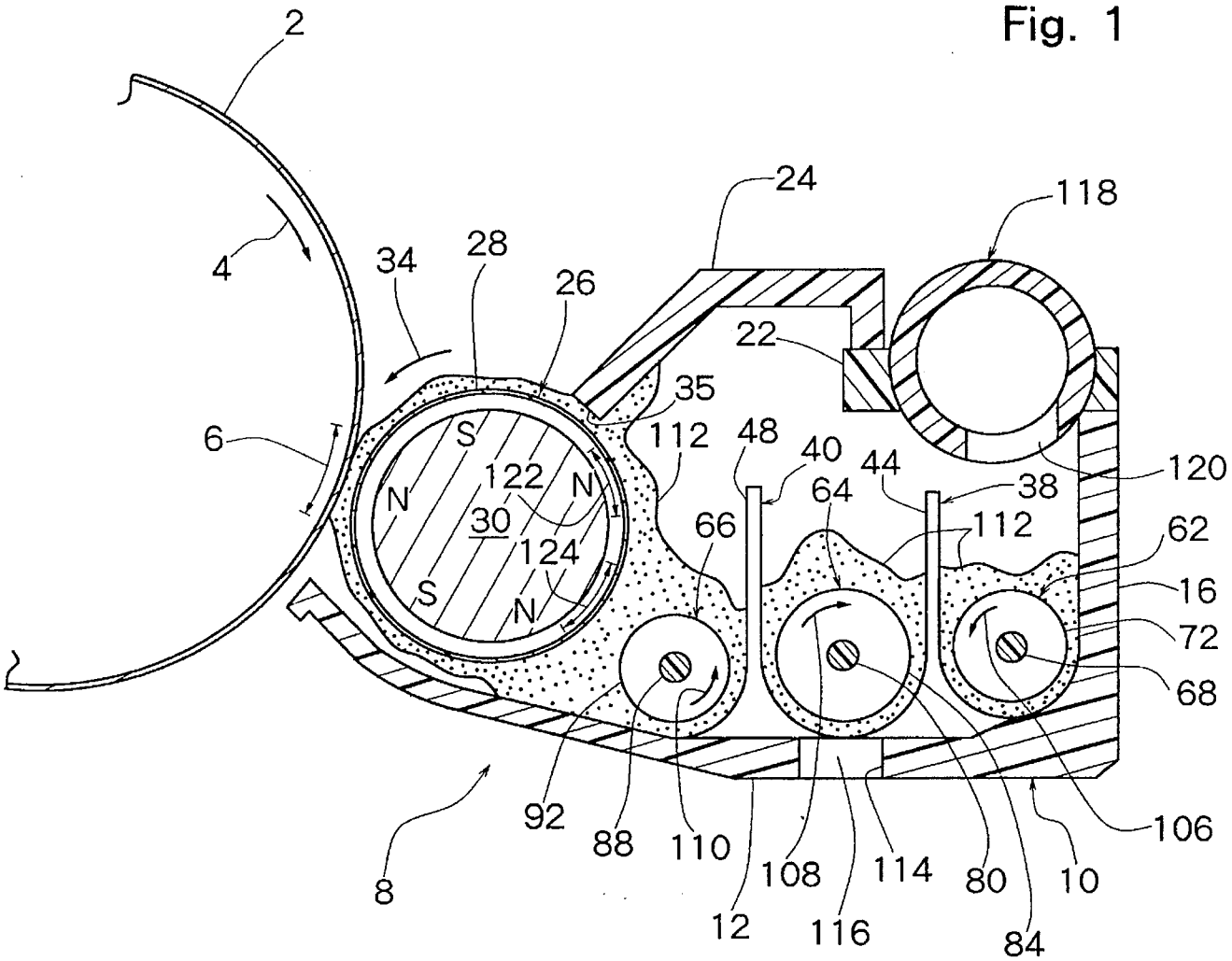
FIG. 1 is a sectional view showing an embodiment of the latent electrostatic image developing device constructed in accordance with the present invention.

FIG. 1 shows a preferred embodiment of a latent electrostatic image developing device constructed in accordance with the present invention, along with a part of a rotating drum 2. The rotating drum 2 having a suitable electrostatic photosensitive material on its peripheral surface is rotated in the direction of an arrow 4, and passed through a developing zone 6. Upstream of the developing zone 6, a latent electrostatic image is formed on the peripheral surface of the rotating drum 2 by a suitable method well known per se. In the developing zone 6, a latent electrostatic image developing device constructed in accordance with the present invention, shown generally at 8, develops the latent electrostatic image on the peripheral surface of the rotating drum 2 to a toner image. Downstream of the developing zone 6, such a toner image is transferred to a transfer member such as paper, and fixed there, to obtain a copy or printed matter.

Figure 2:
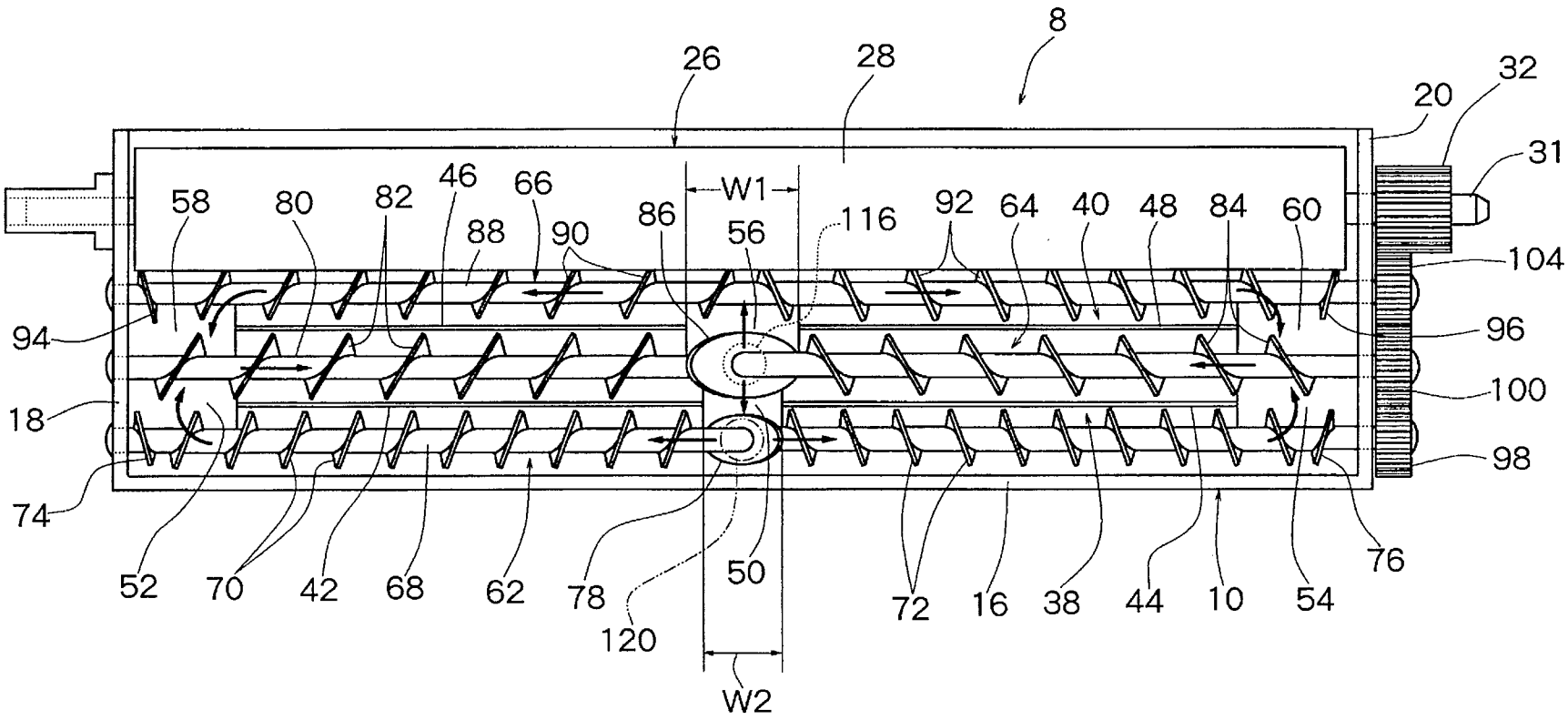
FIG. 2 is a plan view showing the latent electrostatic image developing device illustrated in FIG. 1, with the top wall of the development housing, the cover member, etc. being omitted.

With reference to FIGS. 1 and 2, the latent electrostatic image developing device 8 has a development housing 10. The development housing 10 which may be molded from a suitable synthetic resin includes a bottom wall 12, a rear wall 16 extending substantially vertically upwards from the rear side edge of the bottom wall 12, a front end wall 18, and a rear end wall 20. To the rear wall 16 is connected a top wall 22 projecting substantially horizontally forwards from the upper end of the rear wall 16. To the top wall 22 is further connected a cover wall 24.

At a foremost portion of the development housing 10 (the leftmost portion in FIG. 1; the uppermost portion in FIG. 2) is disposed a developer applicator means 26. The developer applicator means 26 is constructed of a sleeve member 28 extending horizontally in the widthwise direction, and a permanent magnet member 30 disposed within the sleeve member 28. The sleeve member 28 which may be made of aluminum or the like is mounted rotatably, and the permanent magnet member 30 is fixed at a predetermined position. As illustrated in FIG. 2, a rotating shaft 31 on which the sleeve member 28 is fixed protrudes rearwards through the rear end wall 20 of the development housing 10, and an input gear 32 is fixed to a protruding end portion of the shaft 31. The input gear 32 is drivingly connected to a rotary drive source (not shown), which may be an electric motor, via an input gear (not shown) of the rotating drum 2 so as to be rotationally driven in the direction of an arrow 34. A free end 35 of the cover wall 24 for the development housing 10 is located in proximity to the peripheral surface of the sleeve member 28 of the developer applicator means 26. As will be described in further detail later, the free end 35 functions as a so-called tip cutting means for controlling the amount of the developer conveyed to the developing zone 6 while being held on the peripheral surface of the sleeve member 28.

Behind the developer applicator means 26 are disposed an upstream partitioning means 38 and a downstream partitioning means 40 at a predetermined distance from each other in the front-rear direction (the left-right direction in FIG. 1, and the up-down direction in FIG. 2) in the development housing 10. The upstream partitioning means 38 is defined by upright walls 42 and 44 protruding substantially vertically upwards from the bottom wall 12 of the development housing 10. Likewise, the downstream partitioning means 40 is defined by upright walls 46 and 48 protruding substantially vertically upwards from the bottom wall 12 of the development housing 10. As will be clearly understood from FIG. 1, both side surfaces of the lower end portion of each of the upright walls 42, 44, 46 and 48 have a concave arcuate form. As will be clearly understood by reference to FIG. 2, none of the upright walls 42 and 44 are present at the central portion or opposite end portions in the widthwise direction (the direction perpendicular to the sheet surface in FIG. 1, and the left-right direction in FIG. 2), but developer transfer openings 50, 52 and 54 are disposed at the central portion in the widthwise direction and the opposite end portions in the widthwise direction, respectively, of the upstream partitioning means 38. Likewise, none of the upright walls 46 and 48 are present at the central portion or opposite end portions in the widthwise direction, but developer transfer openings 56, 58 and 60 are disposed at the central portion in the widthwise direction and the opposite end portions in the widthwise direction, respectively, of the downstream partitioning means 40. The size in the widthwise direction, W1, of the developer transfer opening 56 disposed at the central portion in the widthwise direction of the downstream partitioning means 40 is set to be greater than the size in the widthwise direction, W2, of the developer transfer opening 50 disposed at the central portion in the widthwise direction of the upstream partitioning means 38. Preferably, the size in the widthwise direction, W1, is 1.3 to 4.0 times as large as the size in the widthwise direction, W2. The size in the width direction of the developer transfer openings 52 and 54 disposed at the opposite end portions in the widthwise direction of the upstream partitioning means 38, and that of the developer transfer openings 58 and 60 disposed at the opposite end portions in the widthwise direction of the downstream partitioning means 40 may all be nearly the same, and advantageously are each nearly the same as the above-mentioned size in the widthwise direction, W1.

A developer agitating/conveying means is also disposed within the development housing 10. The developer agitating/conveying means consists of an upstream agitating/conveying means 62 disposed upstream of (i.e. behind) the upstream partitioning means 38, a midstream agitating/conveying means 64 disposed between the upstream partitioning means 38 and the downstream partitioning means 40, and a downstream agitating/conveying means 66 disposed downstream of (i.e. ahead of) the downstream partitioning means 40. The aforementioned developer applicator means 26 is disposed downstream of the downstream agitating/conveying means 66.

As illustrated clearly in FIG. 2, the upstream agitating/conveying means 62 has a rotating shaft 68 mounted rotatably between both end walls 18 and 20 of the development housing 10. On the rotating shaft 68 are formed a pair of helical blades 70 and 72 at a distance in the widthwise direction (i.e. the axial direction). The helical blade 70 and the helical blade 72 are opposite to each other in terms of the direction of helical winding. The outer diameter of the helical blade 70 and that of the helical blade 72 are the same. Advantageously, the inside end in the widthwise direction of each of the helical blades 70 and 72 is located in correspondence with a position slightly outward in the widthwise direction with respect to the developer transfer opening 50 disposed at the central portion in the widthwise direction of the upstream partitioning means 38, while the outside end in the widthwise direction of each of the helical blades 70 and 72 is located at a position corresponding to nearly the middle in the widthwise direction of each of the developer transfer openings 52 and 54 disposed at the opposite end portions in the widthwise direction of the upstream partitioning means 38. At opposite end portions of the rotating shaft 68 are formed auxiliary helical blades 74 and 76 facing the helical blades 70 and 72, respectively. The outer diameters of the auxiliary helical blades 74 and 76 may be the same as the outer diameters of the helical blades 70 and 72. The directions of helical winding of the auxiliary helical blades 74 and 76 extending over the range with an angle of nearly 360 degrees are opposite to the directions of helical winding of the helical blades 70 and 72 facing the auxiliary helical blades 74 and 76. On the rotating shaft 68 is further formed an inclined elliptic plate 78 at the central portion in the widthwise direction. Preferably, the size in the widthwise direction of the inclined elliptic plate 78 is nearly the same as the size in the widthwise direction of the developer transfer opening 50 formed at the central portion in the widthwise direction of the upstream partitioning means 38. The inclined elliptic plate 78 has a circular shape in its side view, and advantageously the diameter of this circle is substantially the same as the outer diameter of each of the helical blades 70 and 72.

The midstream agitating/conveying means 64 also has a rotating shaft 80 mounted rotatably between both end walls 18 and 20 of the development housing 10. On the rotating shaft 80 are formed a pair of helical blades 82 and 84 at a distance in the widthwise direction (i.e. the axial direction). The helical blade 82 and the helical blade 84 are opposite to each other in terms of the direction of helical winding. The outer diameter of the helical blade 82 and that of the helical blade 84 are the same. Advantageously, the inside end in the widthwise direction of each of the helical blades 82 and 84 is located in correspondence with a position slightly outward in the widthwise direction with respect to the developer transfer opening 56 disposed at the central portion in the widthwise direction of the downstream partitioning means 40, while the outside end in the widthwise direction of each of the helical blades 82 and 84 is located in correspondence with a position nearly in the middle, or slightly outward thereof, in the widthwise direction of each of the developer transfer openings 58 and 60 disposed at the opposite end portions in the widthwise direction of the downstream partitioning means 40. On the rotating shaft 80 is further formed an inclined elliptic plate 86 at the central portion in the widthwise direction. Preferably, the size in the widthwise direction of the inclined elliptic plate 86 is nearly the same as the size in the widthwise direction of the developer transfer opening 56 formed at the central portion in the widthwise direction of the downstream partitioning means 40. The inclined elliptic plate 86 has a circular shape in its side view. Advantageously, the diameter of this circle is substantially the same as the outer diameter of each of the helical blades 82 and 84.

With reference to FIG. 2, the downstream agitating/conveying means 66 also has a rotating shaft 88 mounted rotatably between both end walls 18 and 20 of the development housing 10. On the rotating shaft 88 are formed a pair of helical blades 90 and 92 at a distance in the widthwise direction (i.e. the axial direction). The helical blade 90 and the helical blade 92 are opposite to each other in terms of the direction of helical winding. The outer diameter of the helical blade 90 and that of the helical blade 92 are the same. The distance in the widthwise direction between the helical blade 90 and the helical blade 92 is sufficiently small. Preferably, the inside end in the widthwise direction of each of the helical blades 90 and 92 is located in correspondence with a position nearly in the middle of the developer transfer opening 56 disposed at the central portion in the widthwise direction of the downstream partitioning means 40. Advantageously, the outside end in the widthwise direction of each of the helical blades 90 and 92 is located in correspondence with a position nearly in the middle in the widthwise direction of each of the developer transfer openings 58 and 60 disposed at the opposite end portions in the widthwise direction of the downstream partitioning means 40. At opposite end portions of the rotating shaft 88 are formed auxiliary helical blades 94 and 96 facing the helical blades 90 and 92, respectively. The outer diameters of the auxiliary helical blades 94 and 96 may be the same as the outer diameters of the helical blades 90 and 92. The directions of helical winding of the auxiliary helical blades 94 and 96 extending over the range with an angle of nearly 360 degrees are opposite to the directions of helical winding of the helical blades 90 and 92 facing the auxiliary helical blades 94 and 96. In the aforementioned upstream agitating/conveying means 62 and midstream agitating/conveying means 64, the inclined elliptic plates 78 and 86 are formed at the central portion in the widthwise direction of the rotating shafts 68 and 80. In the downstream agitating/conveying means 66, on the other hand, it should be noted that there is no inclined elliptic plate formed on the rotating shaft 88.

Figure 3:
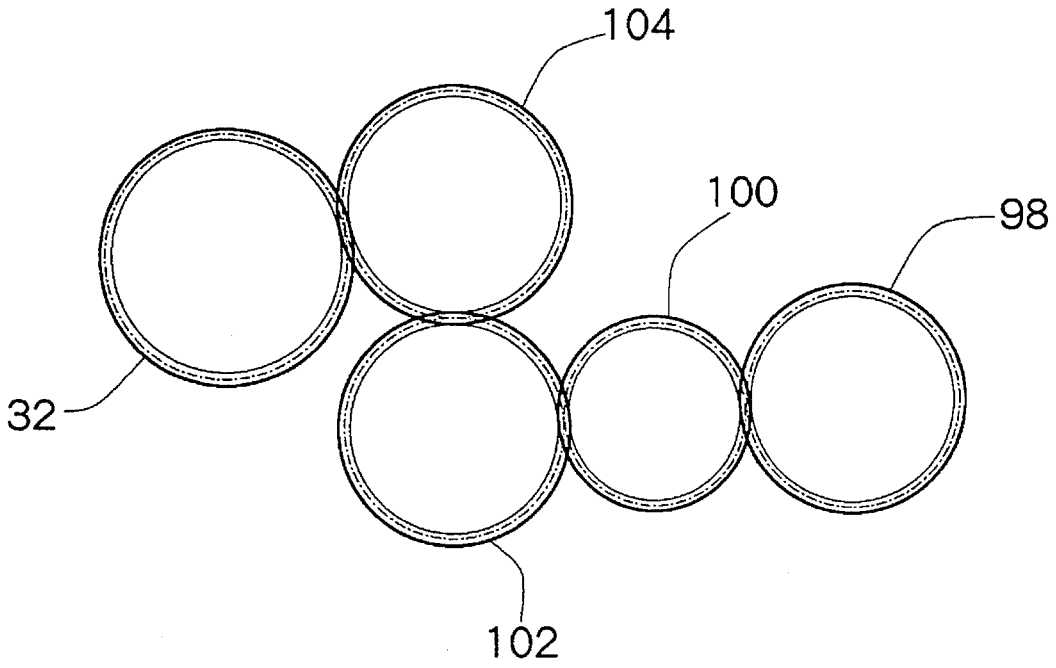
FIG. 3 is a schematic view showing the drivingly connected gears in the latent electrostatic image developing device illustrated in FIG. 1.

With reference to FIGS. 2 and 3, the rotating shaft 68 of the upstream agitating/conveying means 62, the rotating shaft 80 of the midstream agitating/conveying means 64, and the rotating shaft 88 of the downstream agitating/conveying means 66 are each protruded rearwards through the rear end wall 20 of the development housing 10. At the rear end portions of the rotating shafts 68, 80 and 88 are fixed input gears 98, 100 and 102, respectively. The input gear 98 is engaged with the input gear 100, the input gear 100 is engaged with the input gear 102, and the input gear 102 is engaged with the input gear 32 of the developer applicator means 26 via a transmission gear 104 mounted rotatably on the rear end wall 20. Therefore, when the sleeve member 28 of the developer applicator means 26 is rotated by the rotary drive source (not shown) in the direction of arrow 34 , the upstream agitating/conveying means 62 is rotated in the direction of arrow 106, the midstream agitating/conveying means 64 is rotated in the direction of arrow 108, and the downstream agitating/conveying means 66 is rotated in the direction of arrow 110.

As illustrated in FIG. 1, a developer 112 comprising a toner and carrier particles is accommodated into the development housing 10. When housed there, the developer 112 is distributed suitably, i.e. on the side upstream of the upstream partitioning means 38 (the right-hand side in FIG. 1, and the lower side in FIG. 2), between the upstream partitioning means 38 and the downstream partitioning means 40, and on the side downstream of the downstream partitioning means 40 (the left-hand side in FIG. 1, and the upper side in FIG. 2). The upstream agitating/conveying means 62 that is rotated in the direction of arrow 106 conveys the developer from the central portion in the widthwise direction toward the opposite end portions in the widthwise direction on the upstream side of the upstream partitioning means 38 while agitating it. That is, the helical blade 70 of the upstream agitating/conveying means 62 conveys the developer from the central portion in the widthwise direction toward one of the opposite end portions in the widthwise direction (the left end portion in FIG. 2) while agitating it, while the helical blade 72 of the upstream agitating/conveying means 62 conveys the developer from the central portion in the widthwise direction toward the other end portion in the widthwise direction (the right end portion in FIG. 2) while agitating it. The auxiliary helical blade 74 urges the developer inwards in the widthwise direction at one of the opposite end portions in the widthwise direction, while the auxiliary helical blade 76 urges the developer inwards in the widthwise direction at the other end portion in the widthwise direction. The midstream agitating/conveying means 64 that is rotated in the direction of arrow 108 conveys the developer from the opposite end portions in the widthwise direction toward the central portion in the widthwise direction between the upstream partitioning means 38 and the downstream partitioning means 40 while agitating it. That is, the helical blade 82 of the midstream agitating/conveying means 64 conveys the developer from one of the end portions in the widthwise direction (the left end portion in FIG. 2) toward the central portion in the widthwise direction while agitating it, whereas the helical blade 84 of the midstream agitating/conveying means 64 conveys the developer in a similar manner from the other end portion in the widthwise direction. The downstream agitating/conveying means 66 that is rotated in the direction of arrow 110 conveys the developer, while agitating it, from the central portion in the widthwise direction toward the opposite end portions in the widthwise direction on the downstream side of the downstream partitioning means 40. That is, the helical blade 90 of the downstream agitating/conveying means 66 conveys the developer from the central portion in the widthwise direction toward one of the end portions in the widthwise direction (the left end portion in FIG. 2) while agitating it, whereas the helical blade 92 of the downstream agitating/conveying means 66 conveys the developer from the central portion in the widthwise direction toward the other end portion in the widthwise direction (the right end portion in FIG. 2) while agitating it. The auxiliary helical blade 94 urges the developer inwards in the widthwise direction at one of the end portions in the widthwise direction, while the auxiliary helical blade 96 urges the developer inwards in the widthwise direction at the other end portion in the widthwise direction.

It is important that the conveying capacity of the midstream agitating/conveying means 64 which conveys the developer from the opposite end portions in the widthwise direction to the central portion in the widthwise direction be set to be greater than the conveying capacity of each of the upstream agitating/conveying means 62 and the downstream agitating/conveying means 66, each conveying the developer from the central portion in the widthwise direction toward the opposite end portions in the widthwise direction. In order to bring the conveyance of the developer from the opposite end portions in the widthwise direction toward the central portion in the widthwise direction and the conveyance of the developer from the central portion in the widthwise direction toward the opposite end portions in the widthwise direction into substantial equilibrium, thereby rendering the developer present sufficiently uniformly throughout the widthwise direction, it is preferred that the conveying capacity of the midstream agitating/conveying means 64 be nearly equal to with the sum of the conveying capacity of the upstream agitating/conveying means 62 and that of the downstream agitating/conveying means 66. Preferably, the conveying capacity of the downstream agitating/conveying means 66 is set to be larger than the conveying capacity of the upstream agitating/conveying means 62. Advantageously, the conveying capacity of the downstream agitating/conveying means 66 is about 1.2 to 2.5 times as large as the conveying capacity of the upstream agitating/conveying means 62 (the reasons will be offered later on). The conveying capacity of each of the upstream, midstream, and downstream agitating/conveying means 62, 64 and 66 can be set as desired by suitably setting the rotational speed, pitch, and diameter of each of their helical blades 70 and 72, 82 and 84, and 90 and 92, respectively. In the illustrated embodiments, the number of revolutions per unit time of the upstream agitating/conveying means 62 and the number of revolutions per unit time of the downstream agitating/conveying means 66 are the same, while the number of revolutions per unit time of the midstream agitating/conveying means 64 is set to be greater than any of these numbers of revolutions. The pitch of the helical blades 90 and 92 of the downstream agitating/conveying means 66 is greater than the pitch of the helical blades 70 and 72 of the upstream agitating/conveying means 62, while the pitch of the helical blades 82 and 84 of the midstream agitating/conveying means 64 is further greater than that of the helical blades 90 and 92 of the downstream agitating/conveying means 66. The outer diameter of the helical blades 70 and 72 of the upstream agitating/conveying means 62 is the same as the outer diameter of the helical blades 90 and 92 of the downstream agitating/conveying means 66, whereas the outer diameter of the helical blades 82 and 84 of the midstream agitating/conveying means 64 is greater than the outer diameter of the helical blades 70, 72, 90 and 92.

With reference to FIGS. 1 and 2, a circular opening 114 is formed at that site of the bottom wall 12 of the development housing 10 which is situated at the central portion in the widthwise direction between the upstream partitioning means 38 and the downstream partitioning means 40. In this opening 114 is disposed a detector 116 for detecting the concentration of the toner in the developer 112. The detector 116 may be one of a known type per se which can detect the toner concentration of the developer 112 by detecting the magnetic permeability of the developer 112 present on the top surface exposed within the development housing 10 through the opening 114. The latent electrostatic image developing device 8 is further provided with a toner feed means which is actuated depending on the toner concentration of the developer 112 to be detected by the detector 116. Such a toner feed means has a feeding pipe 118 disposed in the top wall 22 of the development housing 10. One end portion of the feeding pipe 118 is located above the central portion in the widthwise direction of the upstream agitating/conveying means 62, and a discharge opening 120 communicating with the inside of the development housing 10 is formed at the lowermost surface of the feeding pipe 118. As shown by a two-dot chain line in FIG. 2, the discharge opening 120 is circular in the plan view, and is situated above the inclined elliptic plate 78 disposed at the central portion in the widthwise direction of the upstream agitating/conveying means 62. The other end portion of the feeding pipe 118 which extends from the one end portion toward the front end in the widthwise direction is made to communicate with a toner container (not shown), and a toner conveying means (not shown) that may be constructed with a helical blade is disposed within the feeding pipe 118. When the toner concentration of the developer 112 detected by the detector 116 becomes less than a predetermined value, the toner conveying means in the feeding pipe 118 is actuated to convey the toner from the toner container via the feeding pipe 118. Then, the toner is caused to fall through the discharge opening 120 onto the inclined elliptic plate 78 of the upstream agitating/conveying means 62 within the development housing 10. When the toner concentration detected by the detector 116 becomes the predetermined value or more, the actuation of the toner conveying means within the feeding pipe 118 is ceased to terminate the toner supply to the development housing 10.

The actions and effects of the latent electrostatic image developing device 8 as described above with reference to FIGS. 1 and 2 are summarized as follows: As indicated by the arrows in FIG. 2, the toner let fall through the discharge opening 120 formed in the feeding pipe 118 of the toner feed means is evenly distributed on both sides from the central portion in the widthwise direction by the action of the inclined elliptic plate 78 of the upstream agitating/conveying means 62, to be mixed with the developer 112 within the development housing 10. The developer 112 present on the upstream side of the upstream partitioning means 38 (the right-hand side in FIG. 1) is conveyed from the central portion in the widthwise direction toward the opposite end portions in the widthwise direction, while being agitated, by the action of the helical blades 70 and 72 of the upstream agitating/conveying means 62. Since the conveying capacity of the upstream agitating/conveying means 62 is set at a relatively low capacity, the developer 112 is conveyed at a relatively low speed from the central portion in the widthwise direction toward the opposite end portions in the widthwise direction by the upstream agitating/conveying means 62. During this motion, the developer 112 is fully agitated. The developer 112 conveyed to the opposite end portions in the widthwise direction is transferred forward through the developer transfer openings 52 and 54 disposed at the opposite end portions in the widthwise direction of the upstream partitioning means 38, and introduced into the space between the upstream partitioning means 38 and the downstream partitioning means 40.

Then, in the space between the upstream partitioning means 38 and the downstream partitioning means 40, the developer 112 is conveyed, while being agitated, from the opposite end portions in the widthwise direction toward the central portion in the widthwise direction by the action of the helical blades 82 and 84 of the midstream agitating/conveying means 64. At the central portion in the widthwise direction of the midstream agitating/conveying means 64, part of the developer 112 is transferred forward through the developer transfer opening 56 disposed at the central portion in the widthwise direction of the downstream partitioning means 40, while another part of the developer 112 is transferred rearward through the developer transfer opening 50 disposed at the central portion in the widthwise direction of the upstream partitioning means 38. During this motion, the action of the inclined elliptic plate 86 of the midstream agitating/conveying means 64 causes the developer 112 conveyed from one side in the widthwise direction to be suitably distributed on both sides in the widthwise direction, and the developer 112 conveyed from the other side in the widthwise direction to be suitably distributed on both sides in the widthwise direction. Since the widthwise size of the developer transfer opening 56 disposed at the central portion in the widthwise direction of the downstream partitioning means 40 is set to be relatively large, a relatively large amount of the developer 112 is advanced to the downstream side of the downstream partitioning means 40 through the developer transfer opening 56. Since the widthwise size of the developer transfer opening 50 disposed at the central portion in the widthwise direction of the upstream partitioning means 38 is set to be relatively small, the developer 112 returned to the upstream side of the upstream partitioning means 38 through the developer transfer opening 50 is in a relatively small amount. Moreover, the toner fallen through the toner discharge opening 120 can be fully reliably prevented from being directly introduced into the space between the upstream partitioning means 38 and the downstream partitioning means 40 through the developer transfer opening 50 without being conveyed under agitation by the upstream agitating/conveying means 62. The developer transferred forward through the developer transfer opening 56 disposed at the central portion in the widthwise direction of the downstream partitioning means 40 is conveyed from the central portion in the widthwise direction to the opposite end portions in the widthwise direction, while being agitated, by the action of the helical blades 90 and 92 of the downstream agitating/conveying means 66. The developer 112 conveyed to the opposite end portions in the widthwise direction is transferred rearward through the developer transfer openings 58 and 60 disposed at the opposite end portions in the widthwise direction of the downstream partitioning means 40, returned to the space between the upstream partitioning means 38 and the downstream partitioning means 40, and then conveyed from the opposite end portions in the widthwise direction toward the central portion in the widthwise direction, while being agitated, by the action of the helical blades 82 and 84 of the midstream agitating/conveying means 64.

Referring to FIGS. 1 and 2, on the downstream side of the downstream agitating/conveying means 66 (the left-hand side in FIG. 1, and the upper side in FIG. 2), the sleeve member 28 of the developer applicator means 26 is rotated in the direction shown by the arrow 34. In a developer draw-up zone indicated at 122 in FIG. 1, the developer 112 that is conveyed from the central portion in the widthwise direction toward the opposite end portions in the widthwise direction, while being agitated, by the helical blades 90 and 92 of the downstream agitating/conveying means 66 is partly drawn up to the peripheral surface of the sleeve member 28 owing to a magnetic field formed by the stationary permanent magnet member 30. The developer 112 drawn up to the peripheral surface of the sleeve member 28 is conveyed in the direction of arrow 34 by the rotation of the sleeve member 28 for transportation to the developing zone 6. During this motion, an excess of the developer 112 is removed from the peripheral surface of the sleeve member 28 by the action of the free end 35 of the cover wall 24 of the development housing 10. In the developing zone 6, the toner in the developer 112 is selectively adhered to a latent electrostatic image formed on the peripheral surface of the rotating drum 4 to develop the latent electrostatic image to a toner image. In a developer peeling zone 124 located downstream of the developing zone 6, the developer 112 is released from the peripheral surface of the sleeve member 28 owing to the reduction of the magnetic field formed by the permanent magnet member 30. Such developer 112 has the decreased toner concentration because of the consumption of the toner in the developing zone 6. The developer 112 released from the peripheral surface of the sleeve member 28 is mixed with the developer 112 within the development housing 10, and conveyed toward the opposite end portions in the widthwise direction, while being agitated, by the helical blades 90 and 92 of the downstream agitating/conveying means-66. Since the conveying capacity of the downstream agitating/conveying means 66 is set to be greater than the conveying capacity of the upstream agitating/conveying means 62, the developer 112 is fully satisfactorily released from the peripheral surface of the sleeve member 28 in the developer peeling zone 124, and such developer 112 is incorporated and agitated fully rapidly into the developer 112 accommodated in the development housing 10.

Next, an experimental example of the latent electrostatic image developing device in accordance with the present invention will be described. A latent electrostatic image developing device of the shape illustrated in FIGS. 1 to 3 was produced, and a latent electrostatic image formed on the peripheral surface of the rotating drum was developed. The details of the main part of the latent electrostatic image developing device were as follows:

The distance between the rear wall of the development housing and the upstream partitioning means (upright wall) (the distance in the horizontal direction): 16 mm. The distance between the upstream partitioning means and the downstream partitioning means (upright wall) (the distance in the horizontal direction): 20 mm. The distance between the downstream partitioning means and the sleeve member (the distance in the horizontal distance): 14 mm. The height from the top surface of the bottom wall of the development housing to the upper end of the upstream partitioning means (upright wall): 30 mm. The height from the top surface of the bottom wall of the development housing to the upper end of the downstream partitioning means (upright wall): 30 mm. The width of the development housing (the distance between the inner surfaces of both side walls): 328 mm. The width of the developer transfer opening at the central portion in the widthwise direction of the upstream partitioning means: 20 mm. The width of each of the developer transfer openings at the opposite end portions in the widthwise direction of the upstream partitioning means: 30 mm. The width of the developer transfer opening at the central portion in the widthwise direction of the downstream partitioning means: 30 mm. The width of each of the developer transfer openings at the opposite end portions in the widthwise direction of the downstream partitioning means: 30 mm. The outer diameter of the rotating shaft in the upstream agitating/conveying means: 6 mm. The outer diameter of the pair of helical blades in the upstream agitating/conveying means: 14 mm. The pitch of the pair of helical blades in the upstream agitating/conveying means: 14 mm. The length in the widthwise direction of each of the pair of helical blades in the upstream agitating/conveying means: 135 mm. The distance (width) between the pair of helical blades in the upstream agitating/conveying means: 32 mm. The number or revolutions of the upstream agitating/conveying means: 459.6 rpm. The outer diameter of the rotating shaft in the midstream agitating/conveying means: 6 mm. The outer diameter of the pair of helical blades in the midstream agitating/conveying means: 17 mm. The pitch of the pair of helical blades in the midstream agitating/conveying means: 20 mm. The length in the widthwise direction of each of the pair of helical blades in the midstream agitating/conveying means: 145 mm. The distance (width) between the pair of helical blades in the midstream agitating/conveying means: 43 mm. The number or revolutions of the midstream agitating/conveying means: 561.7 rpm. The outer diameter of the rotating shaft in the downstream agitating/conveying means: 6 mm. The outer diameter of the pair of helical blades in the downstream agitating/conveying means: 14 mm. The pitch of the pair of helical blades in the downstream agitating/conveying means: 18 mm. The length in the widthwise direction of each of the pair of helical blades in the downstream agitating/conveying means: 135 mm. The distance (width) between the pair of helical blades in the downstream agitating/conveying means: 10 mm. The number or revolutions of the downstream agitating/conveying means: 459.6 rpm. The outer diameter of the sleeve member: 34 mm. The number of revolutions of the sleeve member: 421.3 rpm (the peripheral speed of the sleeve member: 750 mm/sec). The outer diameter of the rotating drum: 78 mm. The number of revolutions of the rotating drum: 73.5 rpm (the peripheral speed of the rotating drum: 300 mm/sec). The distance between the peripheral surface of the sleeve member and the cover member (the tip length): 0.9 mm. The distance between the peripheral surface of the sleeve member and the peripheral surface of the rotating drum (the development distance): 1.0 mm.

The developer (apparent density: about 2 g/cc) weighing 800 g as a whole and containing 24 g of the toner (hence, the weight ratio of the toner: 3%) was accommodated in the development housing of the above-mentioned latent electrostatic image developing device in a suitably distributed state. The supply of the toner from the toner feed means into the development housing was controlled depending on an output from the toner concentration detector so that the weight ratio of the toner in the developer within the development housing could be maintained at 3 to 4%. In this manner, the development of latent electrostatic images obtained under various conditions was performed tens of thousands of times. Toner images thus developed were transferred onto papers, and the quality of their development was evaluated. The results of the evaluations, including the uniformity of development density in the widthwise direction, were fully satisfactory.

The latent electrostatic image developing device constructed in accordance with the present invention produces the following effects by the improvement of the agitation and conveyance of the developer: (1) Even if a latent electrostatic image having a toner adhesion region biased toward one side in the widthwise direction is developed, the mixing ratio of the toner and the carrier particles in the developer is fully prevented from becoming nonuniform, and even the mixing ratio of the toner and the carrier particles becomes nonuniform in the width direction, such nonuniformity, can be fully rapidly eliminated. (2) Even immediately after the toner is fed into the development housing, the incorporation of an insufficiently agitated toner in the developer held on the developer applicator means for carriage to the developing zone is reliably prevented. (3) A desired amount of the developer is held stably and sufficiently uniformly in the widthwise direction on the developer applicator means, and fully satisfactory developments, including uniformity in the widthwise direction, in development quality evaluations, were performed.

What we claim is:

1. A latent electrostatic image developing device comprising a development housing for accommodating a developer comprising a toner and carrier particles, developer applicator means for applying the developer within the development housing to a latent electrostatic image, developer agitating/conveying means for agitating and conveying the developer within the development housing, said developer agitating/conveying means including upstream agitating/conveying means, midstream agitating/conveying means, and downstream agitating/conveying means, and toner feed means for feeding a toner into the development housing, wherein upstream partitioning means and downstream partitioning means, each extending in the widthwise direction, are disposed in the development housing, and developer transfer openings are disposed at opposite end portions in the widthwise direction and a central portion in the widthwise direction of each of the upstream partitioning means and the downstream partitioning means, the upstream agitating/conveying means is disposed on the upstream side of the upstream partitioning means, the midstream agitating/conveying means is disposed between the upstream partitioning means and the downstream partitioning means, the downstream agitating/conveying means is disposed on the downstream side of the downstream partitioning means, and the developer applicator means is disposed on the downstream side of the downstream agitating/conveying means, the upstream agitating/conveying means is so constructed as to convey the developer from the central portion in the widthwise direction toward the opposite end portions in the widthwise direction while agitating it, the midstream agitating/conveying means is so constructed as to convey the developer from the opposite end portions in the widthwise direction toward the central portion in the widthwise direction while agitating it, and the downstream agitating/conveying means is so constructed as to convey the developer from the central portion in the widthwise direction toward the opposite end portions in the widthwise direction while agitating it, and the conveying capacity of the midstream agitating/conveying means is greater than the conveying capacity of the upstream agitating/conveying means and the conveying capacity of the downstream agitating/conveying means.

2. The latent electrostatic image developing device of claim 1 wherein the conveying capacity of the midstream agitating/conveying means is nearly equal to the sum of the conveying capacity of the upstream agitating/conveying means and the conveying capacity of the downstream agitating/conveying means.

3. The latent electrostatic image developing device of claim 1 wherein the conveying capacity of the downstream agitating/conveying means is greater than the conveying capacity of the upstream agitating/conveying means.

4. The latent electrostatic image developing device of claim 3 wherein the conveying capacity of the downstream agitating/conveying means is 1.2 to 2.5 times as large as the conveying capacity of the upstream agitating/conveying means.

5. The latent electrostatic image developing device of claim 1 wherein the size in the widthwise direction of the developer transfer opening disposed at the central portion in the widthwise direction of the downstream partitioning means is greater than the size in the widthwise direction of the developer transfer opening disposed at the central portion in the widthwise direction of the upstream partitioning means.

6. The latent electrostatic image developing device of claim 5 wherein the size in the widthwise direction of the developer transfer opening disposed at the central portion in the widthwise direction of the downstream partitioning means is 1.3 to 4.0 times as large as the size in the widthwise direction of the developer transfer opening disposed at the central portion in the widthwise direction of the upstream partitioning means.

7. The latent electrostatic image developing device of claim 1 wherein the upstream agitating/conveying means, the midstream agitating/conveying means, and the downstream agitating/conveying means are each comprised of a rotating shaft extending in the widthwise direction, and a pair of helical blades formed at a distance in the widthwise direction on the rotating shaft and helically wound about the rotating shaft in opposite directions to each other.

8. The latent electrostatic image developing device of claim 7 wherein in each of the upstream agitating/conveying means and the midstream agitating/conveying means, an inclined elliptic plate is formed on the rotating shaft between the pair of helical blades, and in the downstream agitating/conveying means, an inclined elliptic plate is not formed on the rotating shaft between the pair of helical blades.

9. The latent electrostatic image developing device of claim 8 wherein the size in the widthwise direction of the inclined elliptic plate of the upstream agitating/conveying means is nearly equal to the size in the widthwise direction of the developer transfer opening disposed at the central portion in the widthwise direction of the upstream partitioning means, and the size in the widthwise direction of the inclined elliptic plate of the midstream agitating/conveying means is nearly equal to the size in the widthwise direction of the developer transfer opening disposed at the central portion in the widthwise direction of the downstream partitioning means.

10. The latent electrostatic image developing device of claim 7 wherein in each of the upstream and downstream agitating/conveying means, auxiliary helical blades urging the developer inwards in the widthwise direction are formed at the opposite end portions of the rotating shaft.

11. The latent electrostatic image developing device of claim 1 wherein the toner feed means lets the toner fall onto the central portion in the widthwise direction of the upstream agitating/conveying means.

12. A latent electrostatic image developing device comprising a development housing for accommodating a developer comprising a toner and carrier particles, developer applicator means for applying the developer within the development housing to a latent electrostatic image, developer agitating/conveying means for agitating and conveying the developer within the development housing, said developer agitating/conveying means including upstream agitating/conveying means, midstream agitating/conveying means, and downstream agitating/conveying means, and toner feed means for feeding a toner into the development housing, wherein upstream partitioning means and downstream partitioning means, each extending in the widthwise direction, are disposed in the development housing, and developer transfer openings are disposed at opposite end portions in the widthwise direction and a central portion in the widthwise direction of each of the upstream partitioning means and the downstream partitioning means, the upstream agitating/conveying means is disposed on the upstream side of the upstream partitioning means, the midstream agitating/conveying means is disposed between the upstream partitioning means and the downstream partitioning means, the downstream agitating/conveying means is disposed on the downstream side of the downstream partitioning means, and the developer applicator means is disposed on the downstream side of the downstream agitating/conveying means, the upstream agitating/conveying means is so constructed as to convey the developer from the central portion in the widthwise direction toward the opposite end portions in the widthwise direction while agitating it, the midstream agitating/conveying means is so constructed as to convey the developer from the opposite end portions in the widthwise direction toward the central portion in the widthwise direction while agitating it, and the downstream agitating/conveying means is so constructed as to convey the developer from the central portion in the widthwise direction toward the opposite end portions in the widthwise direction while agitating it, and the size in the widthwise direction of the developer transfer opening disposed at the central portion in the widthwise direction of the downstream partitioning means is greater than the size in the widthwise direction of the developer transfer opening disposed at the central portion in the widthwise direction of the upstream partitioning means.

13. The latent electrostatic image developing device of claim 12 wherein the size in the widthwise direction of the developer transfer opening disposed at the central portion in the widthwise direction of the downstream partitioning means is 1.3 to 4.0 times as large as the size in the widthwise direction of the developer transfer opening disposed at the central portion in the widthwise direction of the upstream partitioning means.

14. The latent electrostatic image developing device of claim 12 wherein the upstream agitating/conveying means, the midstream agitating/conveying means, and the downstream agitating/conveying means are each comprised of a rotating shaft extending in the widthwise direction, and a pair of helical blades formed at a distance in the widthwise direction on the rotating shaft and helically wound about the rotating shaft in opposite directions to each other.

15. The latent electrostatic image developing device of claim 14 wherein in each of the upstream agitating/conveying means and the midstream agitating/conveying means, an inclined elliptic plate is formed on the rotating shaft between the pair of helical blades, and in the downstream agitating/conveying means, an inclined elliptic plate is not formed on the rotating shaft between the pair of helical blades.

16. The latent electrostatic image developing device of claim 15 wherein the size in the widthwise direction of the inclined elliptic plate of the upstream agitating/conveying means is nearly equal to the size in the widthwise direction of the developer transfer opening disposed at the central portion in the widthwise direction of the upstream partitioning means, and the size in the widthwise direction of the inclined elliptic plate of the midstream agitating/conveying means is nearly equal to the size in the widthwise direction of the developer transfer opening disposed at the central portion in the widthwise direction of the downstream partitioning means.

17. The latent electrostatic image developing device of claim 14 wherein in each of the upstream and downstream agitating/conveying means, auxiliary helical blades urging the developer inwards in the widthwise direction are formed at the opposite end portions of the rotating shaft.

18. The latent electrostatic image developing device of claim 12 wherein the toner feed means lets the toner fall onto the central portion in the widthwise direction of the upstream agitating/conveying means.

19. A latent electrostatic image developing device comprising a development housing for accommodating a developer comprising a toner and carrier particles, developer applicator means for applying the developer within the development housing to a latent electrostatic image, developer agitating/conveying means for agitating and conveying the developer within the development housing, said developer agitating/conveying means including upstream agitating/conveying means, midstream agitating/conveying means, and downstream agitating/conveying means, and toner feed means for feeding a toner into the development housing, wherein upstream partitioning means and downstream partitioning means, each extending in the widthwise direction, are disposed in the development housing, and developer transfer openings are disposed at opposite end portions in the widthwise direction and a central portion in the widthwise direction of each of the upstream partitioning means and the downstream partitioning means, the upstream agitating/conveying means is disposed on the upstream side of the upstream partitioning means, the midstream agitating/conveying means is disposed between the upstream partitioning means and the downstream partitioning means, the downstream agitating/conveying means is disposed on the downstream side of the downstream partitioning means, and the developer applicator means is disposed on the downstream side of the downstream agitating/conveying means, the upstream agitating/conveying means is so constructed as to convey the developer from the central portion in the widthwise direction toward the opposite end portions in the widthwise direction while agitating it, the midstream agitating/conveying means is so constructed as to convey the developer from the opposite end portions in the widthwise direction toward the central portion in the widthwise direction while agitating it, and the downstream agitating/conveying means is so constructed as to convey the developer from the central portion in the widthwise direction toward the opposite end portions in the widthwise direction while agitating it, the upstream agitating/conveying means, the midstream agitating/conveying means, and the downstream agitating/conveying means are each comprised of a rotating shaft extending in the widthwise direction, and a pair of helical blades formed at a distance in the widthwise direction on the rotating shaft and helically wound about the rotating shaft in opposite directions to each other, and in each of the upstream agitating/conveying means and the midstream agitating/conveying means, an inclined elliptic plate is formed on the rotating shaft between the pair of helical blades, and in the downstream agitating/conveying means, an inclined elliptic plate is not formed on the rotating shaft between the pair of helical blades.

20. The latent electrostatic image developing device of claim 19 wherein in each of the upstream agitating/conveying means and the downstream agitating/conveying means, auxiliary helical blades urging the developer inwards in the widthwise direction are formed at the opposite end portions of the rotating shaft.

21. The latent electrostatic image developing device of claim 19 wherein the toner feed means lets the toner fall onto the central portion in the widthwise direction of the upstream agitating/conveying means.

* * * * *